US007365282B2

(12) United States Patent
Altonen et al.

(10) Patent No.: US 7,365,282 B2
(45) Date of Patent: Apr. 29, 2008

(54) PULL OUT AIR GAP SWITCH FOR WALLBOX-MOUNTED DIMMER

(75) Inventors: Gregory S. Altonen, Easton, PA (US); Jeremy Nearhoof, Landsdale, PA (US)

(73) Assignee: Lutron Electronics Co., Ltd., Coopersburg, PA (US)

( * ) Notice: Subject to any disclaimer, the term of this patent is extended or adjusted under 35 U.S.C. 154(b) by 234 days.

(21) Appl. No.: 11/169,929

(22) Filed: Jun. 29, 2005

(65) Prior Publication Data

US 2005/0284738 A1 Dec. 29, 2005

Related U.S. Application Data

(60) Provisional application No. 60/584,071, filed on Jun. 29, 2004.

(51) Int. Cl.
*H01H 3/00* (2006.01)

(52) U.S. Cl. ..... 200/331; 200/329

(58) Field of Classification Search ..... 200/18, 200/537–542, 329–331
See application file for complete search history.

(56) References Cited

U.S. PATENT DOCUMENTS

| | | | | |
|---|---|---|---|---|
| 1,572,645 | A | 2/1926 | Francesco | |
| 3,681,552 | A * | 8/1972 | Bailey | 200/295 |
| 4,007,348 | A | 2/1977 | Vanson et al. | |
| 4,429,201 | A | 1/1984 | Dekkers et al. | |
| 4,454,391 | A | 6/1984 | Olsson | |
| 4,783,581 | A | 11/1988 | Flowers et al. | |
| 4,886,946 | A | 12/1989 | Franks, Jr. | |
| 4,988,840 | A | 1/1991 | Carson et al. | |
| D353,798 | S | 12/1994 | Bryde et al. | |
| 5,434,378 | A * | 7/1995 | McLean | 200/537 |
| 5,485,058 | A * | 1/1996 | Watson et al. | 315/194 |
| 5,660,272 | A | 8/1997 | Janniere et al. | |
| 5,753,983 | A * | 5/1998 | Dickie et al. | 700/14 |
| 5,905,442 | A * | 5/1999 | Mosebrook et al. | 340/3.7 |
| 6,018,132 | A | 1/2000 | Chen | |
| 6,114,644 | A | 9/2000 | Nishikawa | |
| 6,196,377 | B1 | 3/2001 | Brown | |
| 6,300,727 | B1 * | 10/2001 | Bryde et al. | 315/294 |
| 6,333,479 | B1 | 12/2001 | Tai | |
| 6,727,446 | B1 | 4/2004 | Mayo et al. | |
| 6,734,381 | B2 | 5/2004 | Mayo et al. | |
| 6,774,328 | B2 * | 8/2004 | Adams et al. | 200/329 |
| 6,815,625 | B1 * | 11/2004 | Leopold et al. | 200/296 |
| 7,190,125 | B2 * | 3/2007 | McDonough et al. | 315/291 |
| 2003/0089587 | A1 | 5/2003 | Mayo et al. | |
| 2004/0065534 | A1 | 4/2004 | Mayo et al. | |

OTHER PUBLICATIONS

International Search Report from Application No. PCT/US2005/023186.

* cited by examiner

*Primary Examiner*—Michael A Friedhofer
(74) *Attorney, Agent, or Firm*—Ostrolenk, Faber, Gerb & Soffen, LLP

(57) ABSTRACT

A push/pull switch control is incorporated into the surface pattern of a wall box dimmer having a planar face surface. The switch control is finger nail operated and contains a finger nail groove which is accessible on the bottom end surface of the operator so it can be withdrawn to an open position. A switch position indicia is exposed when the operator is withdrawn. The notch is preferably curved with the cross-curvature of the human finger nail

14 Claims, 12 Drawing Sheets

PULL OUT AIR GAP SWITCH FOR WALLBOX-MOUNTED DIMMER

FIELD OF THE INVENTION

This application claims the benefit of U.S. Provisional Application No. 60/584,071, filed Jun. 29, 2004.

FIELD OF THE INVENTION

This invention relates to wallbox-mounted dimmers and more particularly relates to an air gap switch, which is easily operable and does not interfere with the appearance of a smooth and continuous outer faceplate for the dimmer.

BACKGROUND OF THE INVENTION

Wallbox dimmers are well known and frequently have a triac, a silicon controlled rectifier (SCR), a field effect transistor (FET), or any other controllably conductive semiconductor structure that is operable to deliver variable power to a lighting load. The controllably conductive device is frequently provided with an on/off control actuator and a dimmer level control actuator mounted in and operable from the front surface of the dimmer. It is desirable to also provide an air gap switch actuator, which can be located in and operated from the same front surface of the device to provide a definite disconnect of the alternating-current (AC) power from the lighting load, independent of the off-time of the controllably conductive power device.

It is very desirable to organize the control acutators on the front surface of the dimmer to present an attractive smooth and uncluttered appearance while also being easy to operate and being "self teaching" to the user.

A number of wallbox dimmers with such control acutators are well known.

One such device is sold by Lutron Electronics Co. Inc. under the trademark "MAESTRO" in which the faceplate of the wallbox dimmer has a relatively flat surface. A large rectangular on/off acutator occupies most of the faceplate surface for controlling the on and off operation of the semiconductor control device (or the controllably conductive device). A narrow vertically elongated area on one side of the tap switch contains a very narrow dimming control rocker actuator for controlling the dimming level of the connected lighting load by appropriate control of the semiconductor device. A further narrow area on the other side of the on/off actuator carries a line of spaced light emitting diodes (LEDs) or the like which illuminate in sequence to indicate the dimming level set by the dimming control rocker acutator.

Finally, an air gap switch actuator is contained below the on/off actuator. This air gap switch actuator is a thin, laterally movable control, moving along an axis of elongation from left to right to operate an internal air gap switch, which can positively disconnect the input AC power from the lighting load. Thus, the user need not rely on the semiconductor device to be nonconductive (through actuation of the on/off actuator) to insure that the lighting load is disconnected from the AC power (so that the load circuit can be more safely maintained). The air gap switch acutator moves an elongated shaft with an enlarged camming surface between two spring leafs which carry respective contacts located within the enclosure or housing of the dimmer. When moved to the open position, the cam shaft presses the leaf springs and thus their contacts apart to open the internal air gap switch.

The on/off actuator, the dimming control rocker actuator, and the air gap switch actuator are organized to present a flat surface in which the controls are approximately coplanar. (The actuators need very little motion from their planar surfaces to operate their respective switches within the dimmer enclosure and they protrude very little above the surface of the faceplate.) However, since the air gap switch actuator must move laterally between a left-hand position and a right-hand position, a gap necessarily exists to the left or to the right of the air gap switch actuator, depending on its setting. This is an unattractive gap in the otherwise continuous surface of the face. Further, the air gap switch actuator is hard to operate since its surface is flush with the adjacent faceplate surface; and it is difficult to clearly display to the user that the internal air gap switch is open, i.e., that no AC power is being delivered to the lighting load.

It would be very desirable to arrange the air gap switch of the "MAESTRO" dimmer so that it fills the surface of the face plate in a smooth, continuous manner and so that its off position is easily observable, and so that it is easily operated by a user.

Another wallbox dimmer made by Lutron Electronics Co. Ltd. is a device sold under the trademark "FAEDRA". This device is unlike the "MAESTRO" device, but has an air gap switch actuator, which has a push/pull (or push/out) motion (as contrasted to the lateral motion of the "MAESTRO" dimmer). As in the "MAESTRO" dimmer, the push/pull control also moves an elongated cam-carrying shaft which cams apart a pair of leaf springs which carry respective contacts to open the contacts when the push/pull operator is moved to a position to open the internal air gap switch.

Such dimmers are shown in U.S. Pat. Nos. 6,734,381 and 6,727,446. This dimmer has a surface, which carries a vertically elongated elliptical contact for on/off actuation with a protruding relatively high elliptical surface, which occupies the major portion of the faceplate. A relatively high dimmer rocker actuator extends along one surface of the elliptical on/off actuator. The elliptical control button protrudes beyond the periphery of the dimmer rocker actuator, thus departing from a planar configuration for the faceplate. The push/pull air gap switch control then extends under the elliptical on/off actuator for the control of the semiconductor device.

To control the internal air gap switch, a groove is placed in the bottom surface of the air gap switch actuator, which can be operated by a user's finger or finger nail. It is not possible, however, to gain access to the air gap switch actuator from the top. Also, the operation or position of the air gap switch is not apparent to the user. Further, it is not part of a continuous smooth outer surface for the device face plate.

BRIEF DESCRIPTION OF THE INVENTION

In accordance with the invention, a novel push/pull air gap switch actuator is incorporated into the surface pattern of a "MAESTRO" type wallbox dimmer. The push/pull air gap switch actuator has a cam lever which operates a single leaf spring which carries a single contact located within the enclosure of the dimmer, relative to a stationary cooperating contact, permitting a reduction in the operating force needed to operate the air gap switch. Further, when the air gap switch is closed, its external operator is flush with the flat surface of the air gap switch actuator face, the on/off actuator face, and the dimming control rocker actuator, thus keeping the integrity of a flat smooth appearance for the front of the dimmer.

The air gap switch actuator has two operating grooves (or finger-nail catches) one on the top surface and the other on the bottom surface at the operator end of the air gap switch actuator. The grooves are preferably tapered outward from their bottom. The bottom groove is easily engaged by a user's fingernail, and, significantly, the top surface of the operator end of the actuator also contains a groove which can be reached by virtue of a beveled surface in the top of the on/off actuator adjacent the top surface of the air gap operator. The bevel acts as a shadow mask so the top groove is not visible when the control is closed and is otherwise flush and continuous in appearance with the faceplate surface. Further, when the actuator is withdrawn to open the internal air gap switch, an enlarged area of the top of the acutator is exhibited to the user and carries the designation "OFF", or a color code, or the like, indicating the off position, so the user readily can observe that the air gap switch is open.

Further, the top groove and/or bottom groove may be closed at their ends to add strength to the operator end of the otherwise thin cross-section of the molded plastic air gap switch actuator. However, when the on/off actuator operator is depressed (to close the contacts within the enclosure), its surface is continuous with the flat appearance of the outer surface of the faceplate.

The grooves in the top and bottom of the operator end of the air gap switch actuator are dimensioned to comfortably receive the fingernail of most users. Thus, the bottom groove can be about 0.037 inch wide and deep and will accommodate the fingernails of at least 95% of a measured population. Similarly, a groove about 0.032" wide in the top surface of the operator would be easily operable by 95% of the measured population. These are non-critical dimensions. It has been found that leaving a web about 0.020" between the outer wall of the grooves and the face surface of the operator provides sufficient strength in a molded plastic actuator to prevent breakage of the section. Further, it is preferred to retain a web about 0.035" thick between the bottoms of the top and bottom grooves to prevent breakage of the actuator at that location.

DETAILED DESCRIPTION OF THE DRAWINGS

Figure 1:
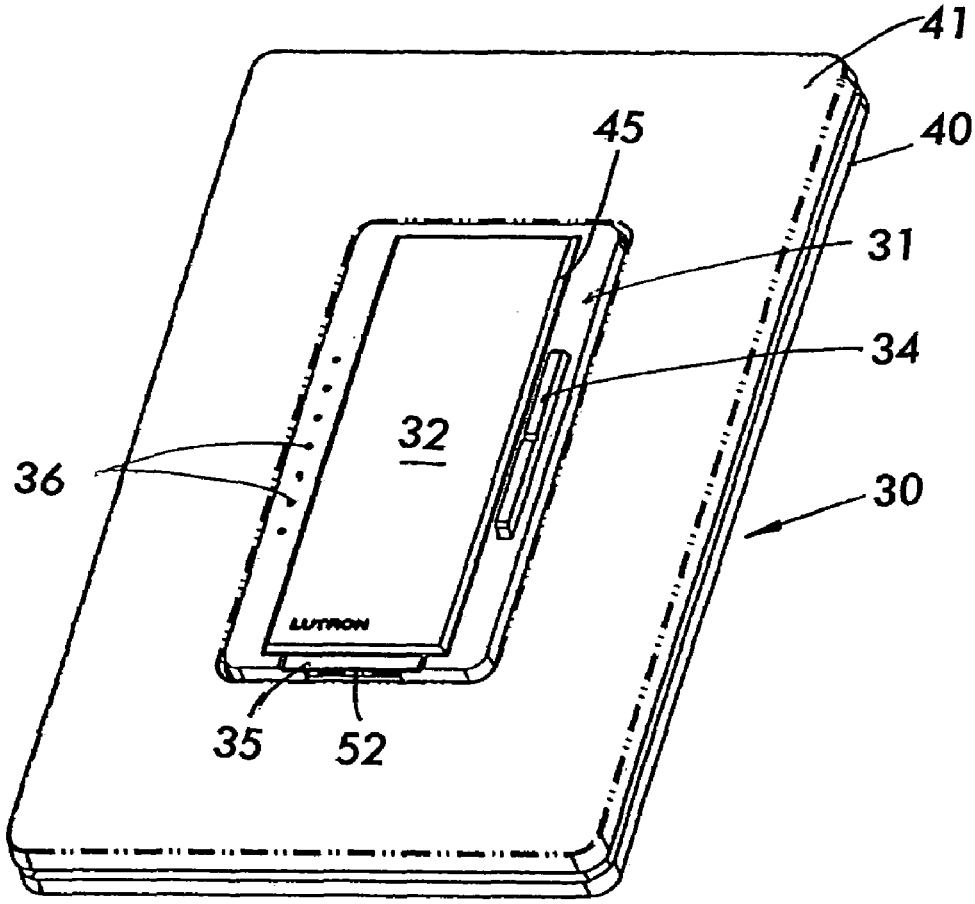
FIG. 1 is a perspective view of a wallbox dimmer (with a decorative faceplate shown in dotted lines) and showing the novel push/pull air gap switch actuator in the closed position (i.e., the "on" position).
Figure 2:
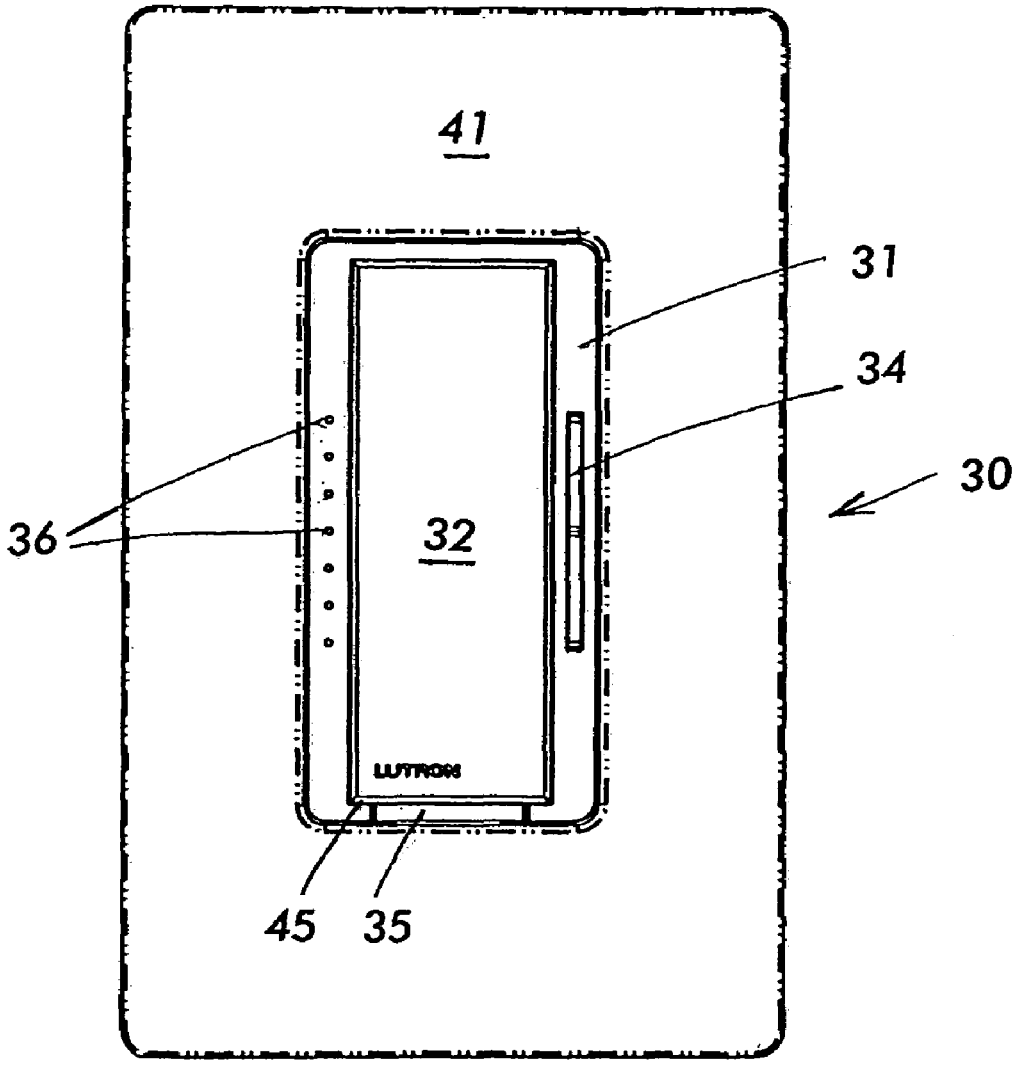
FIG. 2 is a front view of FIG. 1.
Figure 3:
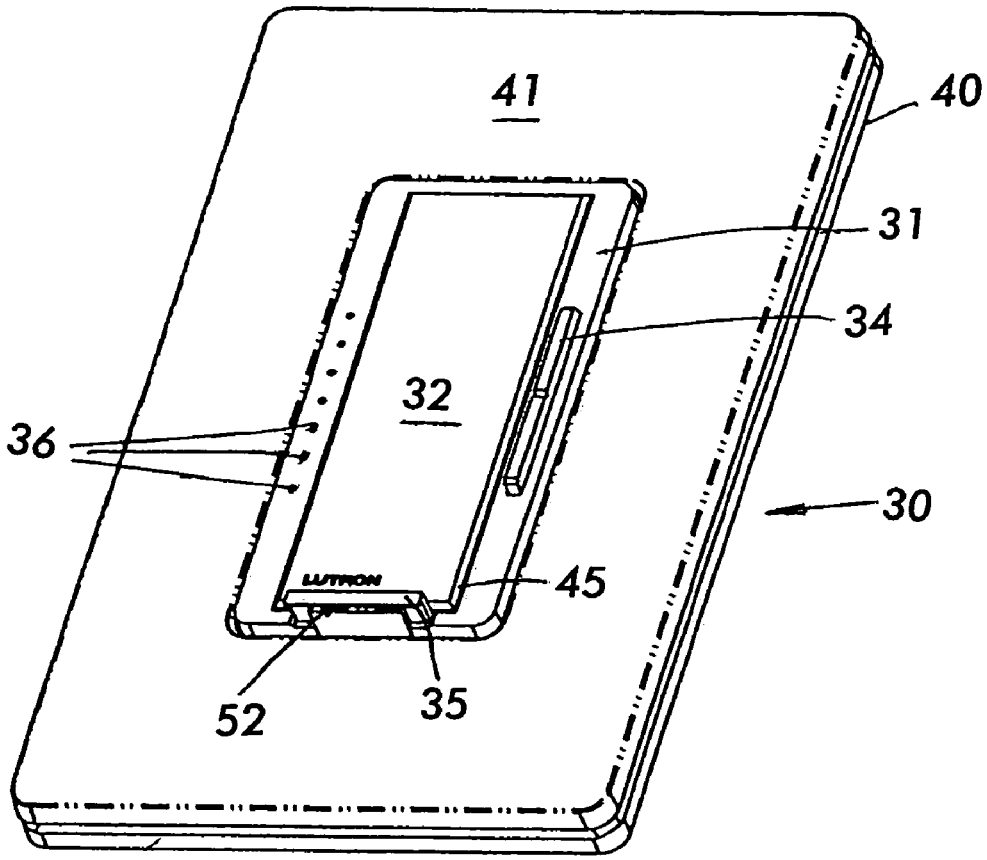
FIG. 3 is a perspective view of the wallbox dimmer of FIGS. 1 and 2 with the push/pull air gap switch actuator in the open position (i.e., the pulled-out or "off" position).
Figure 4:
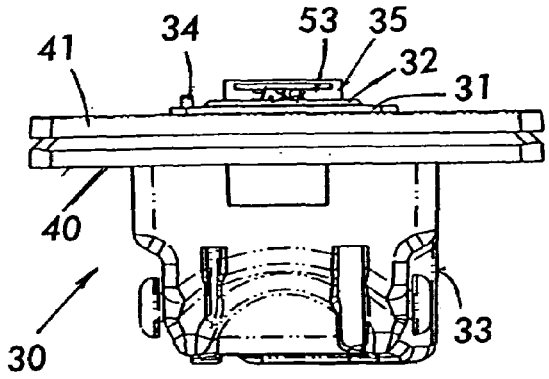
FIG. 4 is a top view of FIG. 3, showing the top of the extending surface of the on/off air gap switch actuator, and showing the enclosure of the dimmer.
Figure 5:
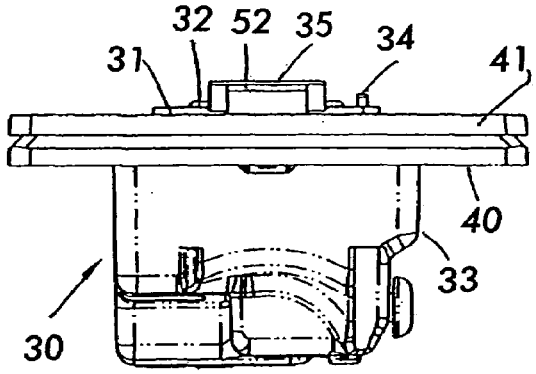
FIG. 5 is a bottom view of FIG. 3, showing the bottom of the air gap switch actuator in the open position and the enclosure of the dimmer.
Figure 6:
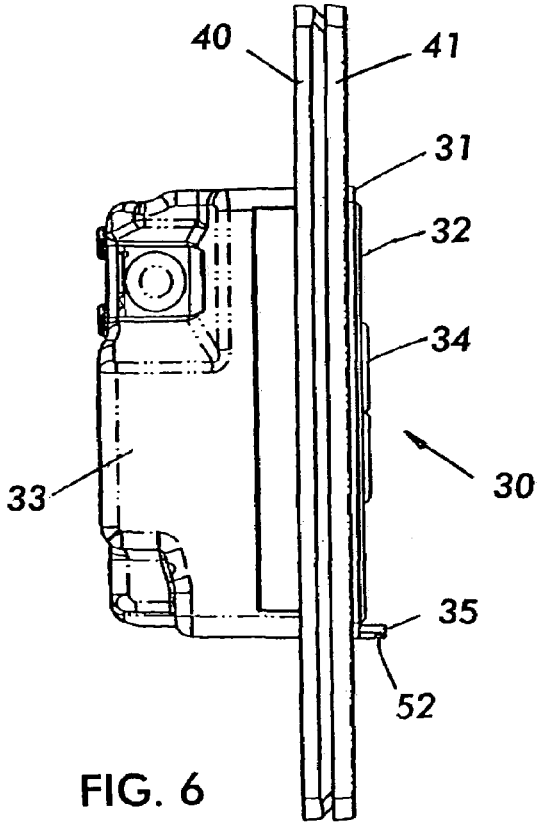
FIG. 6 is a side view of FIG. 3, again showing the air gap switch actuator in the open position and the enclosure of the dimmer.
Figure 7:
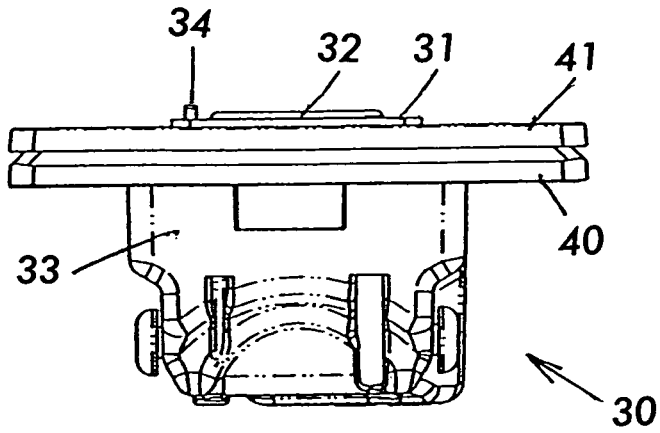
FIG. 7 is a top view of FIG. 2, showing the air gap switch actuator in its closed and flush position.
Figure 8:
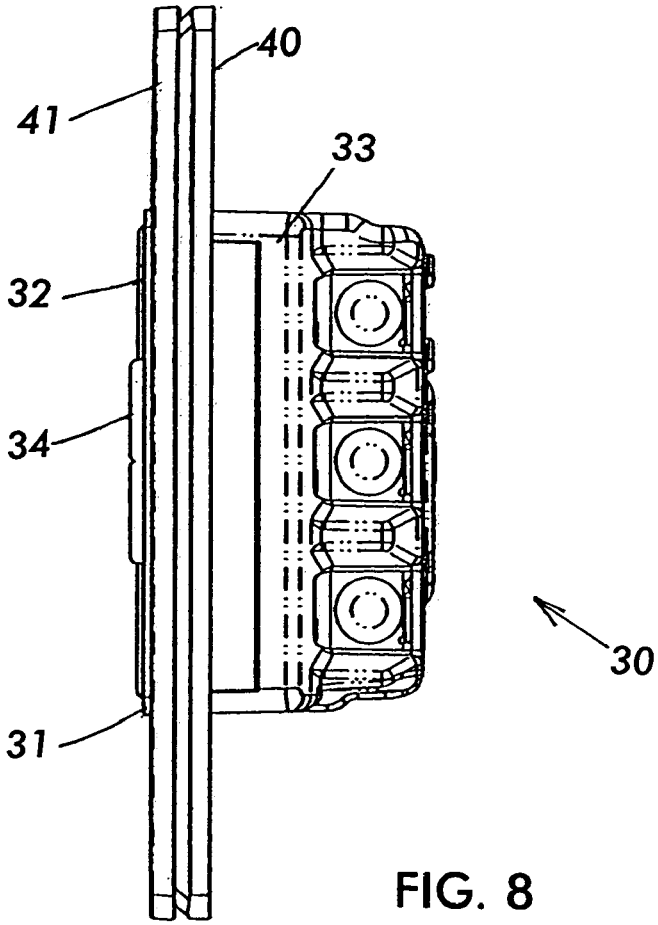
FIG. 8 is a side view of FIG. 2, showing the air gap switch actuator in its closed and flush position.
Figure 9:
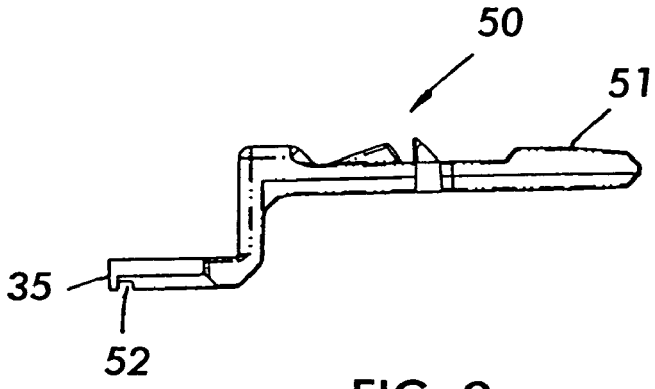
FIG. 9 is a side view of the molded plastic push/pull air gap switch actuator of the preceding figures.
Figure 11:
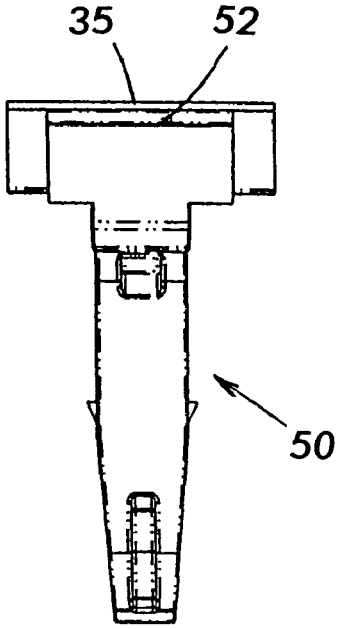
FIG. 11 is a bottom view of FIG. 9.

Referring first to FIGS. 1 through 8, there is shown a wallbox dimmer 30, which has a bezel 31 of any suitable molded plastic and receives a molded on/off actuator 32 for turning on or off the semiconductor control device (not shown) within an enclosure 33. The bezel 31 also receives a molded dimming control rocker actuator 34 for controlling the dimming level of the lighting load controlled by the dimmer 30, and an air gap switch operator 35 for controlling an internal air gap switch (not shown), also within the enclosure 33. (The present invention deals with the structure of the air gap switch actuator and the operator 35.) A line of LED devices 36 extends through the bezel 31 to provide an indication of the dimming level set by the rocker actuator 34.

The bezel 31 extends through an opening in a mounting plate 40. A decorative faceplate 41 is snap-connected to the mounting plate 40. All of these parts are molded plastic and, except for air gap switch operator 35, are similar to those of the Lutron Electronics Co. Inc. "MAESTRO" wallbox dimmer.

The operator 35 is seen to be flush with the bezel 31, the faceplate 41, the on/off actuator 32, and the rocker actuator 34, as shown in FIGS. 1, 2, 7 and 8, in which the air gap switch is closed, and as shown in FIGS. 3, 4, 5 and 6, in which the air gap switch is pulled out (i.e., open).

Significantly, the full front appearance of the entire assembly (with the air gap switch operator 35 in the "on" position and the internal air gap switch closed) is that of a substantially flat uncluttered surface. (See for example, the substantial planarity of the front surface in FIGS. 1, 2, 7 and 8). Further, note that the edge of on/off actuator 32 is beveled around its periphery by bevel 45, as shown in FIGS. 1 to 4, creating a small gap atop the top surface of the end of the operator 35. This gap is not easily seen from the front of the dimmer 30 because of a "shadow effect" but it permits easy access to the top surface of the operator 35 as will be seen.

Figure 10:
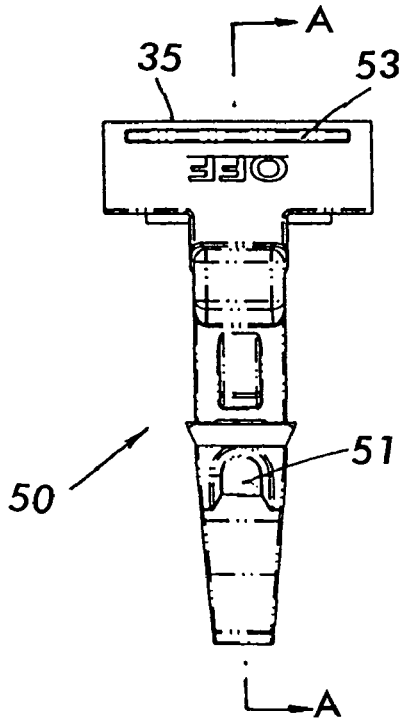
FIG. 10 is a top view of FIG. 9.
Figure 12:
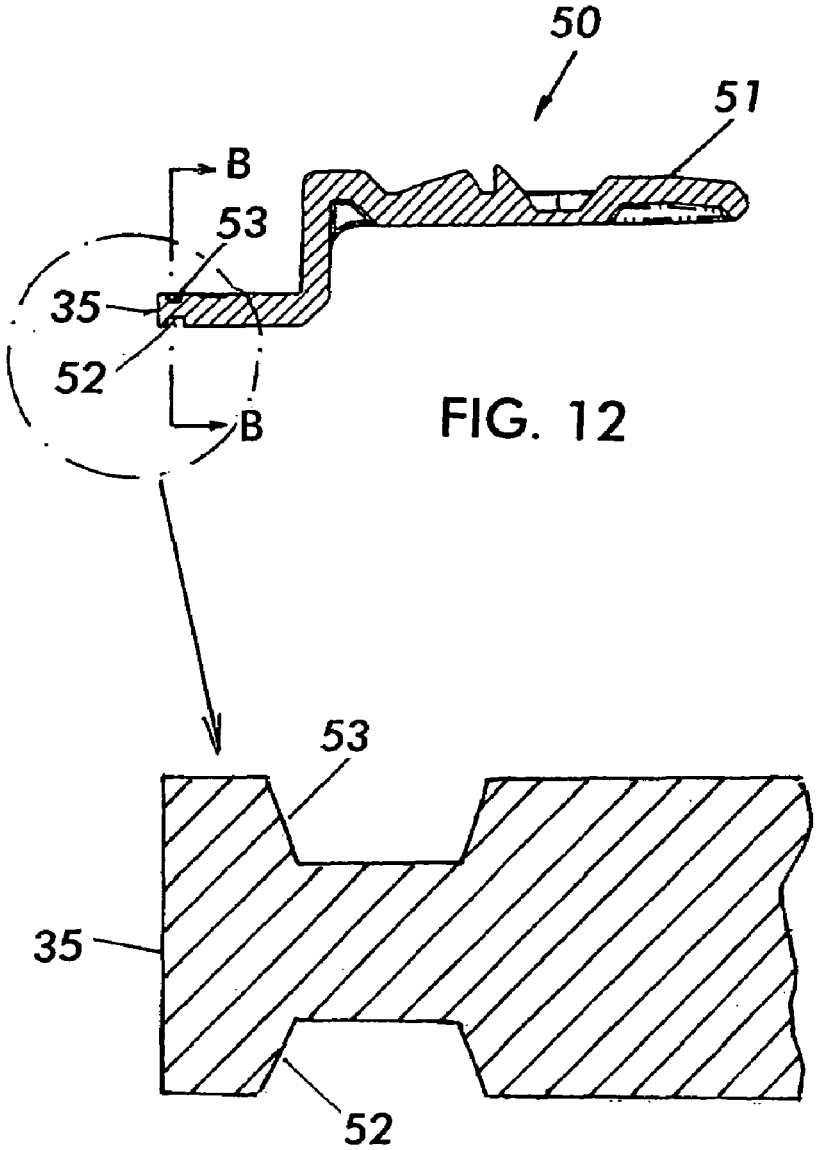
FIG. 12 is a cross-sectional view across section line A-A in FIG. 10.
Figure 13:
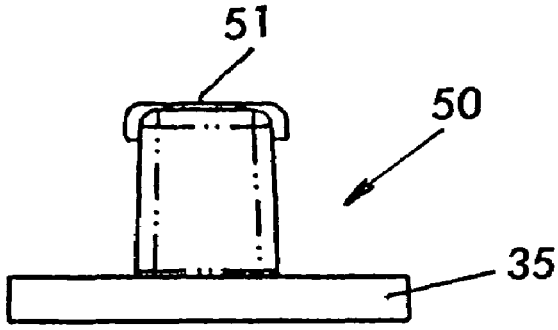
FIG. 13 is a side view of FIG. 9 as seen from its left hand side.
Figure 14:
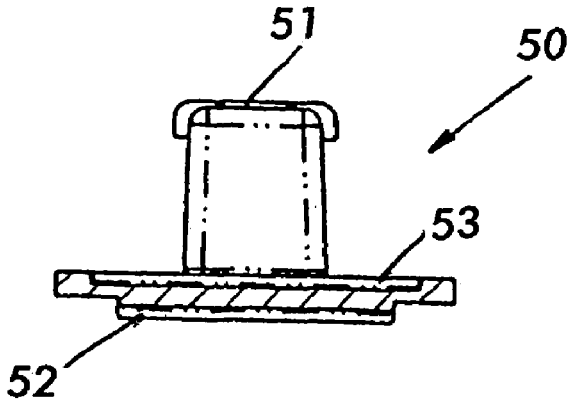
FIG. 14 is a cross-sectional view of FIG. 12, taken across section line B-B in FIG. 12.

FIGS. 9 to 14 show the detail of the structure of an air gap switch actuator 50 (having a front section comprising the operator 35). The air gap switch actuator 50 is a molded part having cam section 51 which opens the internal air gap switch in the enclosure 33 when the actuator 50 is pulled out to the position shown in FIG. 3, as will be later described. Significantly, the bottom surface of the operator 35 of the actuator 50 has a bottom groove 52 (as shown in FIGS. 9, 11, 12 and 14) and the top surface of the operator 35 of the actuator 50 has a top groove 53 (as shown in FIGS. 10, 13 and 14). Note that the top groove 53 has closed ends, for mechanical strength. The top groove 53 has the label "OFF" molded adjacent and interiorly of top groove 53. This symbol becomes visible when the actuator 50 is withdrawn to its open position as in FIG. 4.

The width of the bottom groove 52 is preferably about 0.037"±0.005" and a similar depth (non-critical). A slight taper is provided, opening from the bottom of the groove 52 to its top. The groove 52 is about 0.020" from the operator 35 of the actuator 50. This geometry is generally shown in the enlargement to FIG. 12. Note the displacement of the top groove 53 and the bottom groove 52 relative to one another. The top groove 53 is generally aligned with the bottom groove 52. The top groove 53 has a width of about 0.032"±0.005" (non-critical) and is about 0.020" from the operator 35. The top groove 53 is also tapered open from its base to its top. The depth of the top groove 53 is also about 0.032". Note that the distance between the bottoms of bottom groove 52 and the top groove 53 is about 0.035" to ensure sufficient strength to withstand breakage during operation (see FIG. 12).

Figure 15:
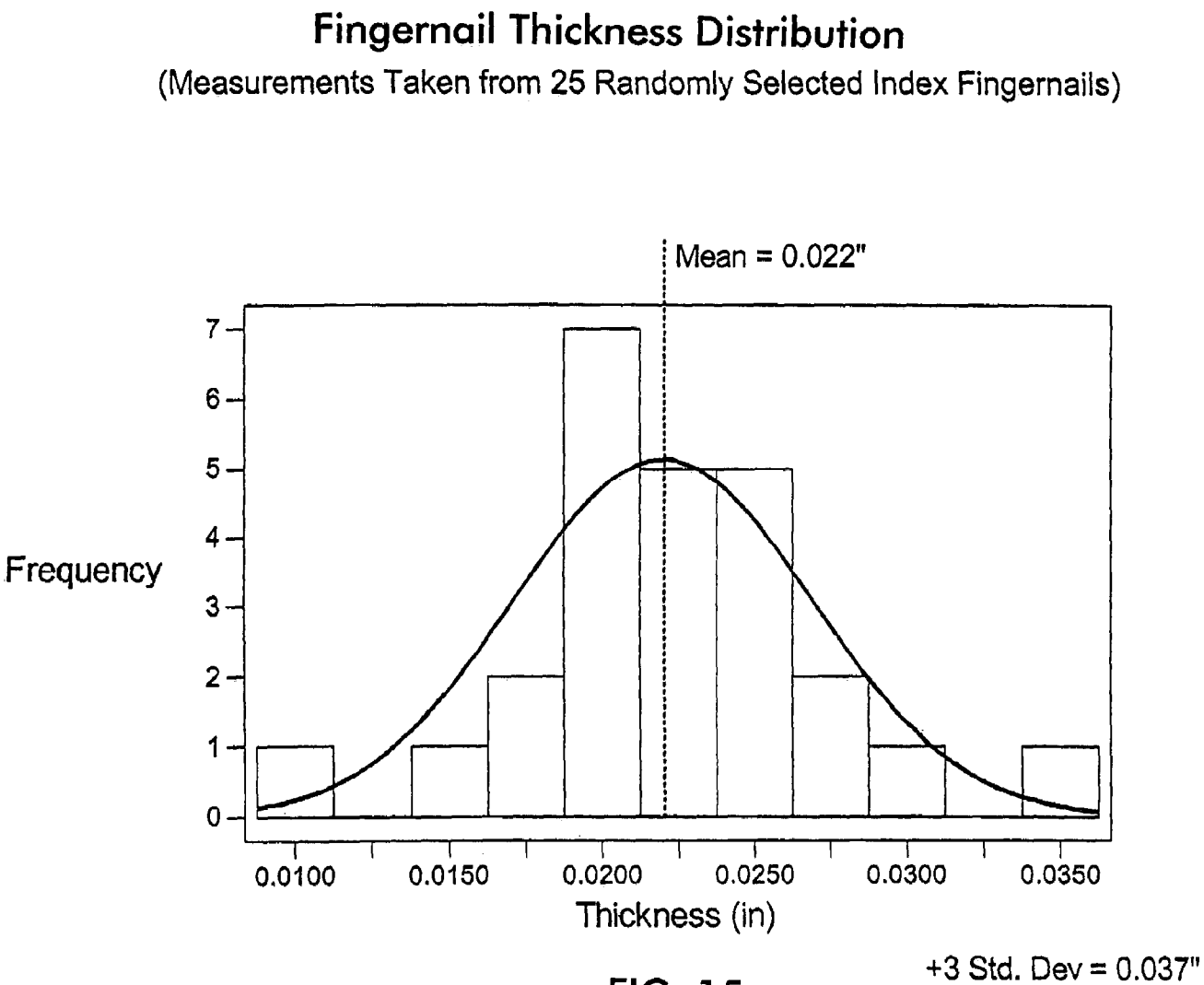
FIG. 15 shows a fingernail thickness distribution over a limited population sample to show the basis for the selection of a groove width for the air gap switch actuator of the preceding figures.
Figure 16:
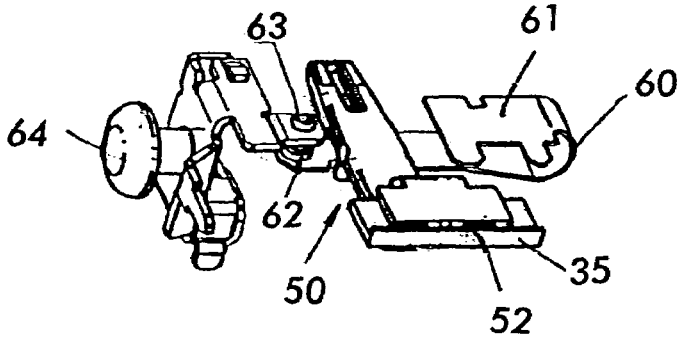
FIG. 16 shows in perspective view the manner in which the actuator of FIGS. 9 to 14 operates air gap switch contacts.

FIG. 15 shows a determination of fingernail thickness of a selected group of people, used to determine a minimum groove thickness for the bottom 52 and the top groove 53. It was determined that a groove width of 0.037" would be usable by 95% of the population sample.

The actuator 50 is slidably mounted within molded guides within the bezel 31 and moves between its fixed open and closed positions.

FIGS. 16 to 19 show how the actuator 50 operates the internal air gap switch contacts. Thus, a single leaf spring 60 is mounted to a fixed structure, e.g., the enclosure 33 (not shown), at a base 61 and carries a moveable contact 62 at its free end. The moveable contact 62 is manually pressed into connection with a fixed contact 63 by the spring 60. The fixed contact 63 is then connected to a screw terminal 64, which is in the input AC circuitry of the dimmer 30. These parts are, of course, within the enclosure 33 of the dimmer 30 as shown in FIGS. 4 to 8.

Figure 17:
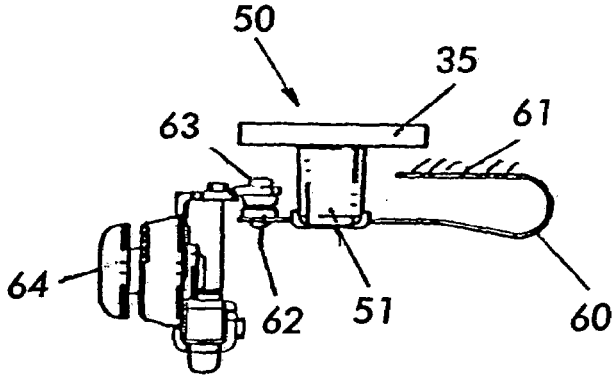
FIG. 17 is an end view of FIG. 16.
Figure 18:
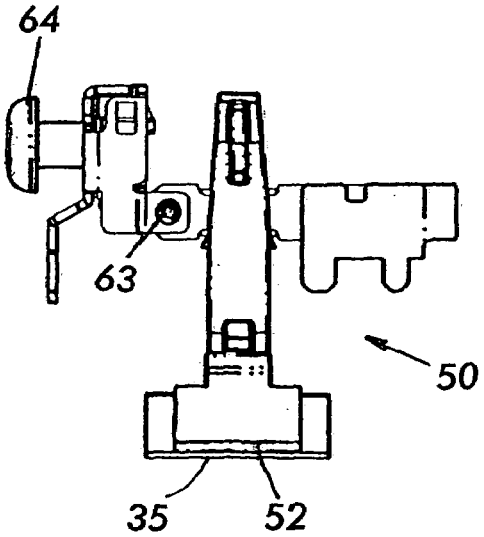
FIG. 18 is a top view of FIG. 16.
Figure 19:
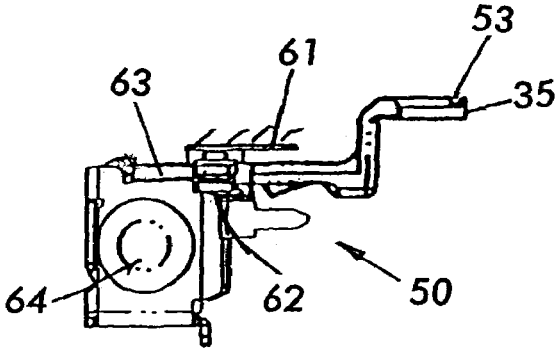
FIG. 19 is a side view of FIG. 16.

These parts are mounted such that the movement of the actuator 50 to the switch open position (by withdrawal of operator 35 from the bezel 31) will cause the cam section 51 to press the free end of the leaf spring 60 and the moveable contact 62 away from the fixed contact 63 (see FIG. 17). However, when the actuator 50 is in its full depressed position in which the operator 35 is flush with the bezel 31, the spring 60 will retract into the depression in front of the cam section 51 to permit closure of the contacts 62 and 63.

FIGS. 20 to 23 are schematic perspectives that illustrate a human finger 80 and fingernail 81 operating different versions of the novel actuator 50 of the present invention.

Figure 20:
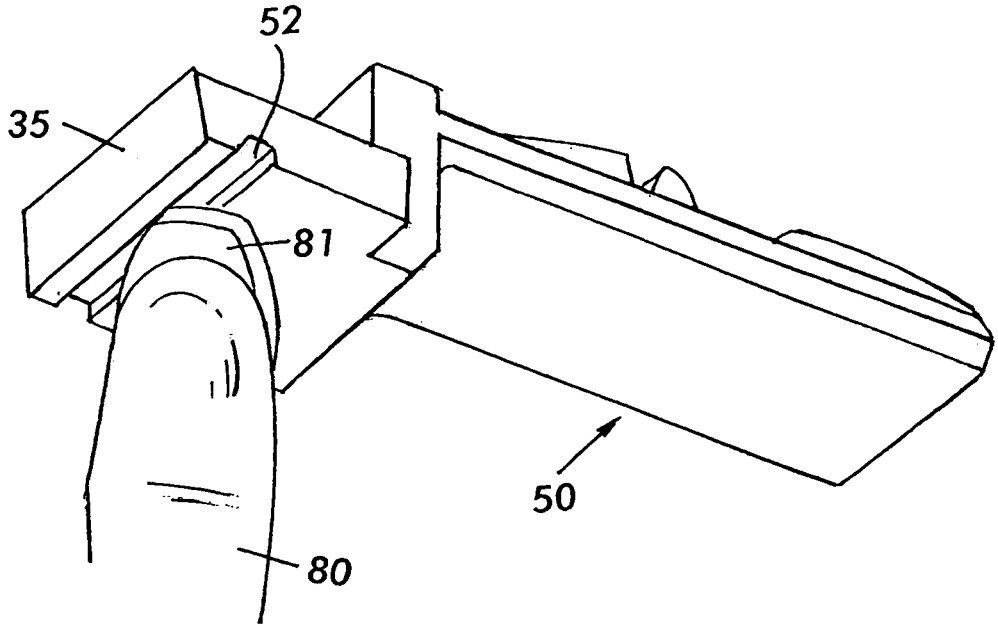
FIG. 20 is a schematic view showing the operation of the air gap switch actuator with only a bottom groove.

FIG. 20 shows the actuator 50 with only the bottom groove 52.

Figure 21:
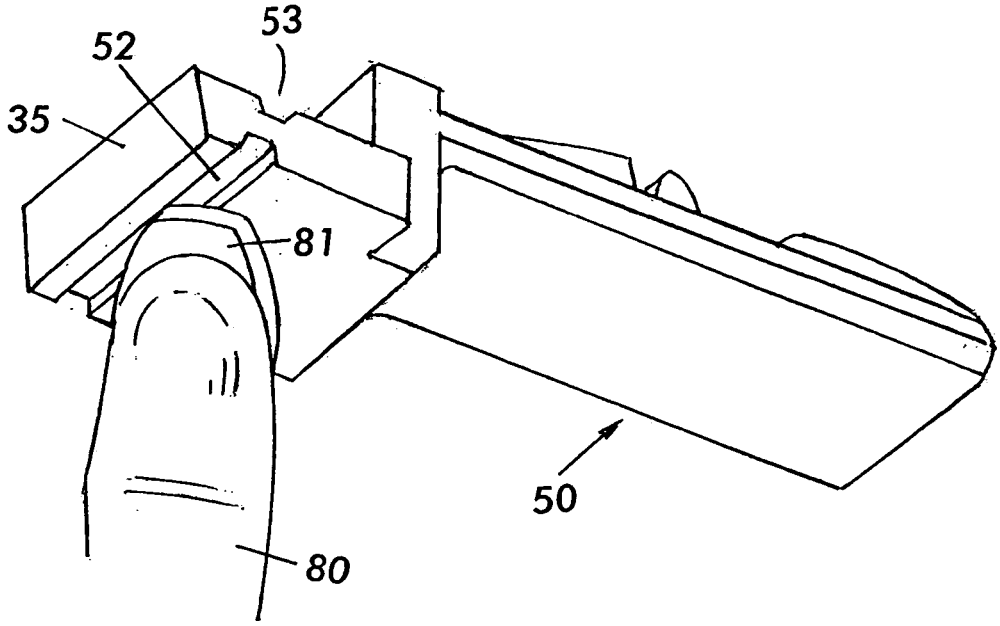
FIG. 21 is like FIG. 20, but shows top and bottom grooves.

FIG. 21 is similar to FIG. 20 but includes the top groove 53.

Figure 22:
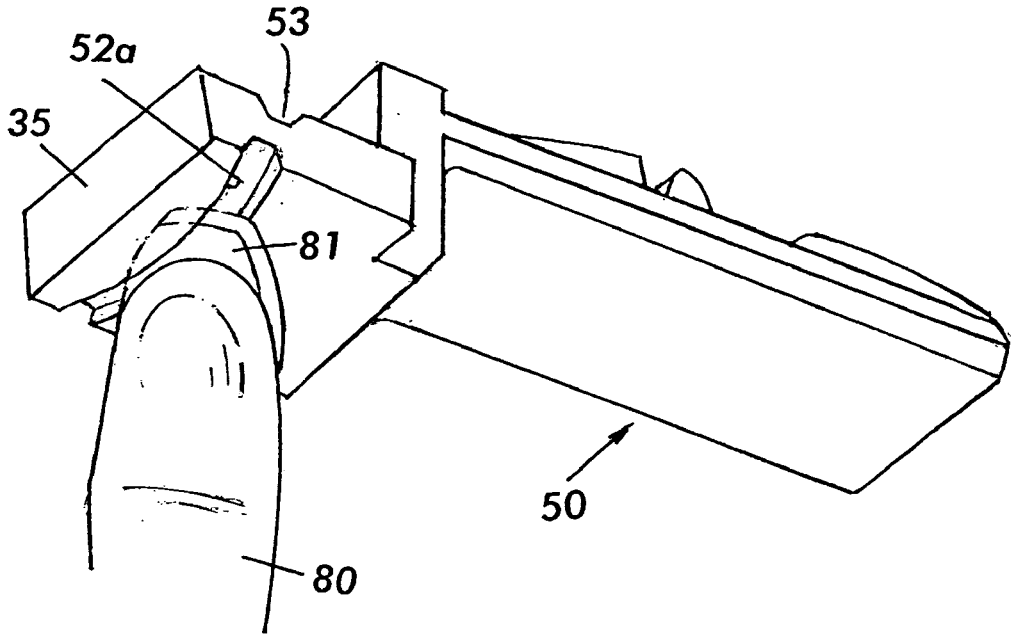
FIG. 22 is like FIG. 20, but shows that the bottom groove may be arcuate.

FIG. 22 is similar to FIG. 21 but shows the bottom groove 52 as an arcuate slot 52*a*.

Figure 23:
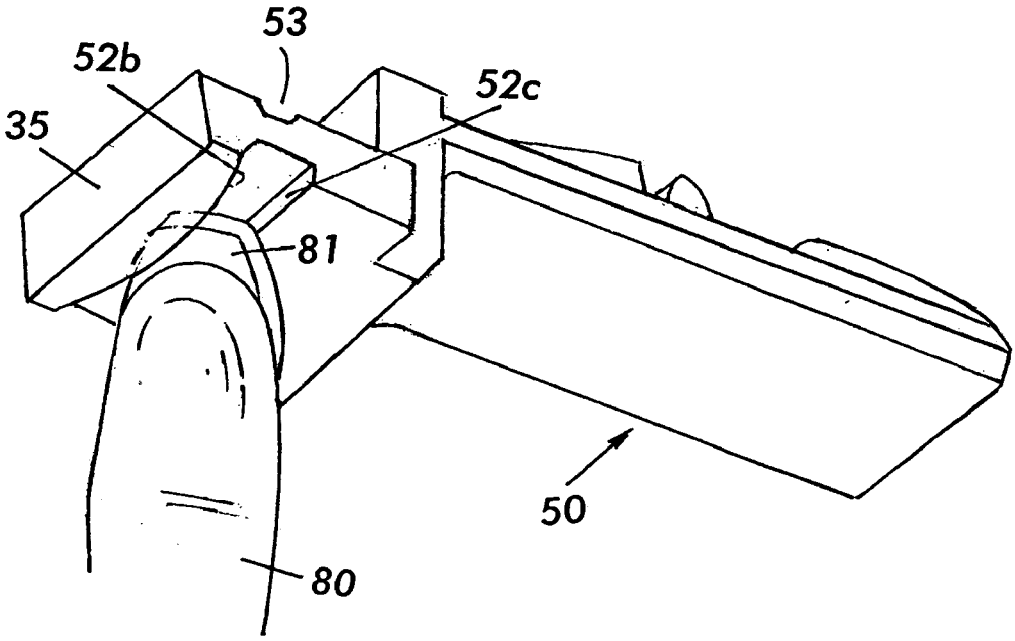
FIG. 23 is like FIG. 22 but shows that the walls of the bottom groove may have one arcuate surface and one flat surface.

FIG. 23 is similar to FIG. 22, but shows that the bottom groove 52 can have an arcuate wall 52*b* and a straight wall 52*c*.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A wall box lighting control comprising a wall box having a generally planar face plate and a generally planar bezel protruding through an opening in said face plate; said wall box containing a pair of cooperating air-gap contacts interiorly thereof and an elongated air gap switch operator mechanically cooperable with said pair of contacts and movable between a first and second position to cause the opening and closing respectively of said pair of contacts; one end portion of said elongated air gap switch operator being disposed adjacent and parallel to an edge portion of said bezel and being movable from a flush position with said bezel when said air gap contacts are closed to a position above the plane of said bezel when said air gap contacts are open; an outer bottom edge portion of said air gap switch operator which is spaced away from said edge portion of said bezel containing a finger nail receiving notch for easy operation of said air gap switch operator to open said air gap contacts; an electronic on/off circuitry, and a planar on/off operator disposed in said bezel and coupled to said electronic on/off circuitry, said on/off operator including a beveled edge providing a gap between a top edge of said one end portion of said air gap switch operator and said beveled edge, said gap being hidden by a shadow effect but providing access to said top edge of said one end of said air gap switch operator whereby said air gap switch operator may be manually operated by accessing said top edge of said one end as well as said finger nail receiving notch.

2. The lighting control of claim 1, wherein said notch has at least one cross-curvature surface which corresponds to the cross-curvature of the human finger nail.

3. The lighting control of claim 1, wherein said notch is tapered outwardly from the bottom.

4. The lighting control of claim 1, wherein said notch extends for substantially a full width of said air gap switch operator but is closed at the ends for ruggedness.

5. The lighting control of claim 1, wherein said outer edge portion of said operator has an exposed surface perpendicular to the plane of said bezel when said operator is moved to said position to open said air gap switch and above the plane of said bezel; said exposed surface having a visual operating position indicia thereon.

6. The lighting control of claim 1, which further includes a dimmer circuit disposed within said wall box and a generally elongated dimmer operator in said bezel and connected to said dimmer circuit; said elongated dimmer operator further presenting an unbroken planar appearance with said on/off operator and said air gap switch operator.

7. The lighting control of claim 6, wherein said notch has at least one cross-curvature surface which corresponds to the cross-curvature of the human finger nail.

8. The lighting control of claim 7, wherein said notch is tapered outwardly from the bottom.

9. The lighting control of claim 8, wherein said notch extends for substantially a full width of said air gap switch operator but is closed at the ends for ruggedness.

10. The lighting control of claim 9, wherein said outer edge portion of said operator has an exposed surface perpendicular to the plane of said bezel when said operator is moved to said position above the plane of said bezel; said surface having a visual operating position indicia thereon.

11. The lighting control of claim 6, wherein said outer edge portion of said operator has an exposed surface perpendicular to the plane of said bezel when said operator is moved to said position above the plane of said bezel; said surface having a visual operating position indicia thereon.

12. A finger nail operated switch comprising a pair of relatively moveable contacts; an elongated switch operator operatively coupled to said contacts; an enclosing housing enclosing said contacts and receiving said elongated switch operator; said elongated switch operator being moveable between a switch-open and switch-closed position for opening and closing said contacts respectively; one end of said elongated switch operator protruding slightly above a surface of said housing and being movable to a further withdrawn position above the surface of said housing for opening said contacts; a surface of said operator which is perpendicular to said surface of said housing and which is exposed when said contacts are closed containing a finger nail notch for engaging said operator with a finger nail to withdraw said operator to said switch-open position, and a second notch opposite to said finger nail notch and accessible to a user.

13. The switch of claim 12, wherein said finger nail notch has a cross-curvature to correspond to the curvature of the human finger nail.

14. The switch of claim 12, wherein one of said pair of contacts is fixed relative to said housing and the other contact is flexibly carried on a spring mounted relative to said housing and is biased toward contact with said fixed contact; said operator having a cam surface which operatively engages said other contact for moving said contact out of engagement with said fixed contact when said operator is withdrawn to said switch-open position.

* * * * *